US008971732B2

(12) United States Patent
Watanabe

(10) Patent No.: US 8,971,732 B2
(45) Date of Patent: Mar. 3, 2015

(54) IMAGE FORMING APPARATUS WITH A SHEET DETECTION UNIT THAT DETECTS A SHEET IN THE CONVEYANCE PATH AND IN THE STORAGE UNIT

(71) Applicant: Canon Kabushiki Kaisha, Tokyo (JP)

(72) Inventor: Kenji Watanabe, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 13/907,555

(22) Filed: May 31, 2013

(65) Prior Publication Data

US 2013/0336667 A1 Dec. 19, 2013

(30) Foreign Application Priority Data

Jun. 5, 2012 (JP) ..... 2012-128130

(51) Int. Cl.
*G03G 15/00* (2006.01)

(52) U.S. Cl.
CPC ..... *G03G 15/6555* (2013.01); *G03G 15/6558* (2013.01); *G03G 15/6502* (2013.01); *G03G 15/6514* (2013.01); *G03G 15/70* (2013.01); *G03G 2215/00721* (2013.01); *G03G 2215/00725* (2013.01)
USPC ..... 399/23; 399/392; 399/401; 271/9.09

(58) Field of Classification Search
USPC ..... 399/23, 388, 389, 392, 401; 271/9.01, 271/9.09, 9.13
See application file for complete search history.

(56) References Cited

U.S. PATENT DOCUMENTS 6,292,636 B1 * 9/2001 Kwon ..... 399/16
8,540,242 B2 * 9/2013 Ise ..... 271/265.04
2007/0286656 A1 * 12/2007 Ito ..... 399/389

FOREIGN PATENT DOCUMENTS

JP 2006-182463 A 7/2006

* cited by examiner

*Primary Examiner* — Blake A Tankersley

(74) *Attorney, Agent, or Firm* — Canon USA Inc. IP Division

(57) ABSTRACT

An image forming apparatus includes a storage unit to store sheets fed to an image forming unit, a sheet guide disposed above the storage unit and to form a sheet conveyance path, on which a sheet is conveyed, a detection unit disposed above the sheet guide and including a light emitting portion to emit light and a light receiving portion to receive light, a light passage portion disposed in the sheet guide, through which light emitted from the light emitting portion in the detection unit passes, a reflection portion disposed below the storage unit and to reflect towards the light receiving portion, light emitted from the light emitting portion and having passed through the light passage portion, and a control unit to determine, based on light received by the light receiving portion, whether there is a sheet in the sheet conveyance path and whether there is a sheet stored.

9 Claims, 19 Drawing Sheets

IMAGE FORMING APPARATUS WITH A SHEET DETECTION UNIT THAT DETECTS A SHEET IN THE CONVEYANCE PATH AND IN THE STORAGE UNIT

BACKGROUND OF THE INVENTION

1. Field of the Invention

The present invention relates to an image forming apparatus which forms an image on a sheet.

2. Description of the Related Art

A sheet cassette in an image forming apparatus stores sheets on which images are to be formed. The image forming apparatus feeds the sheets one by one from the sheet cassette to an image forming unit, and the image forming unit forms images on the sheets.

Japanese Patent Application Laid-Open No. 2006-182463 discusses a sensor disposed in the sheet cassette, which detects whether a sheet or sheets are present in the sheet cassette. The sensor detects whether the sheets in the sheet cassette have run out while the sheets are sequentially fed from the sheet cassette. The image forming apparatus temporarily stops an image forming operation based on detection by the sensor, and notifies a user that the sheets in the sheet cassette have run out.

Japanese Patent Application Laid-Open No. 2006-182463 discusses disposing a dedicated sensor for detecting whether there is a sheet in the sheet cassette. Further, a dedicated space is necessary for arranging the sensor in the apparatus. It is thus desirable to commonly use the sensor so that cost can be reduced and the apparatus can be downsized.

SUMMARY OF THE INVENTION

The present invention is directed to providing a low-cost and compact image forming apparatus.

According to an aspect of the present invention, an image forming apparatus that forms an image on a sheet using an image forming unit includes a storage unit configured to store sheets to be fed to the image forming unit, a feeding unit configured to feed the sheets stored in the storage unit, a sheet guide disposed above the storage unit and configured to form a sheet conveyance path, on which a sheet is conveyed, a detection unit disposed above the sheet guide and including a light emitting portion configured to emit light towards the storage unit and a light receiving portion configured to receive light, a light passage portion disposed in the sheet guide, through which light emitted from the light emitting portion in the detection unit passes, a reflection portion disposed below the storage unit and configured to reflect, towards the light receiving portion, light emitted from the light emitting portion and having passed through the light passage portion, and a control unit configured to determine, based on an amount of light received by the light receiving portion, whether there is a sheet in the sheet conveyance path and whether there is a sheet stored in the storage unit.

Further features of the present invention will become apparent from the following description of exemplary embodiments with reference to the attached drawings.

DESCRIPTION OF THE EMBODIMENTS

According to the first exemplary embodiment of the present invention, a color image forming apparatus employing an intermediate transfer belt will be described as an example.

<Configuration of the Image Forming Apparatus>

Figure 1:
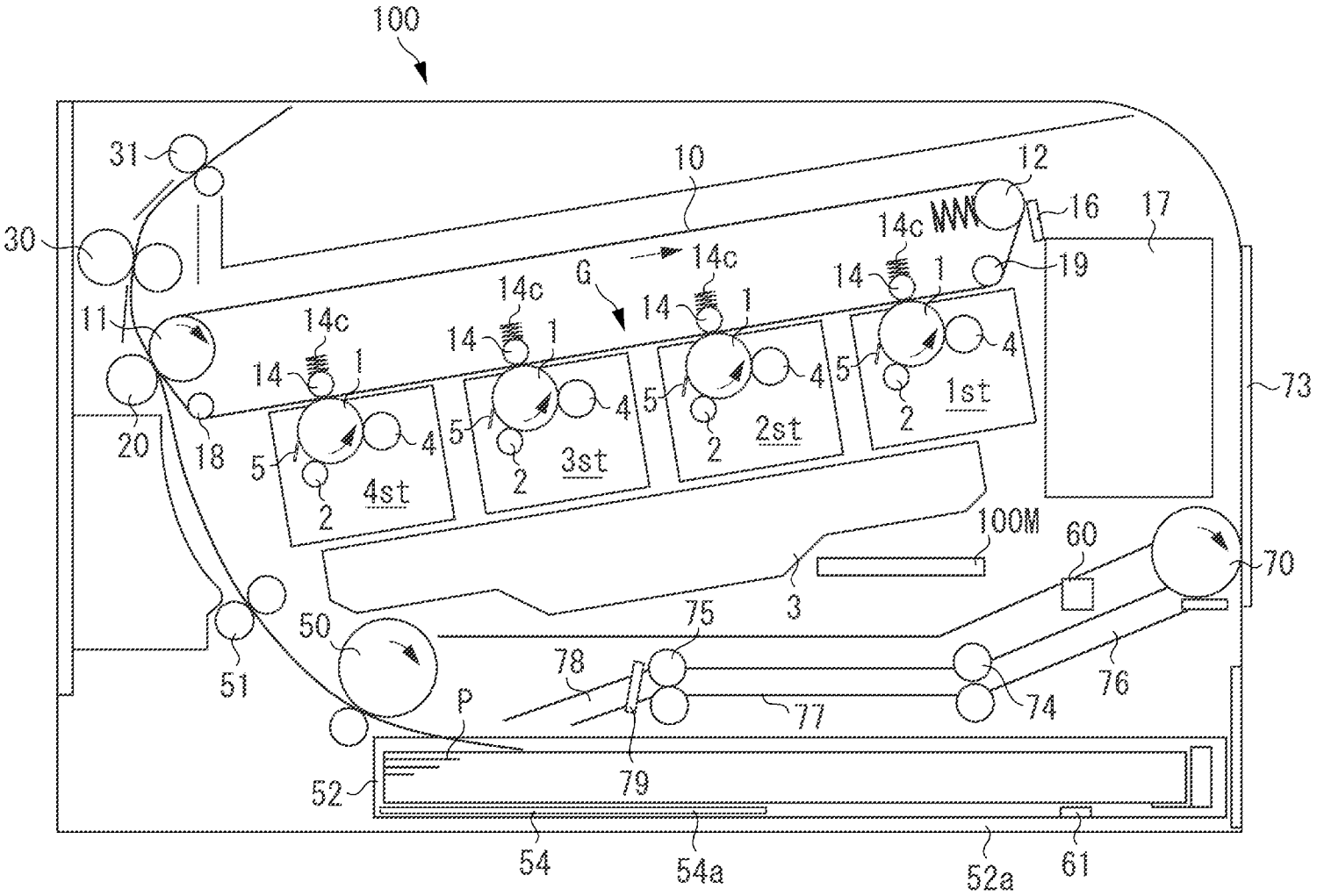
FIG. 1 is a cross-sectional view illustrating an image forming apparatus according to a first exemplary embodiment of the present invention.

FIG. 1 is a cross-sectional view illustrating an image forming apparatus 100. Referring to FIG. 1, a sheet feeding unit is disposed in a lower portion of the image forming apparatus. The sheet feeding unit, i.e. a first feeding unit, includes a sheet cassette 52, which stores the sheets, and a feeding roller 50 which feeds the sheets stored in the sheet cassette 52. The sheet cassette 52 includes an elevating plate 54, which supports a leading edge portion with respect to a feeding direction of the sheet stored in the sheet cassette 52. The elevating plate 54 is attached to a cassette frame 52*a* to be swingable around a fulcrum 54*a* disposed upstream with respect to the sheet feeding direction.

Figure 2:
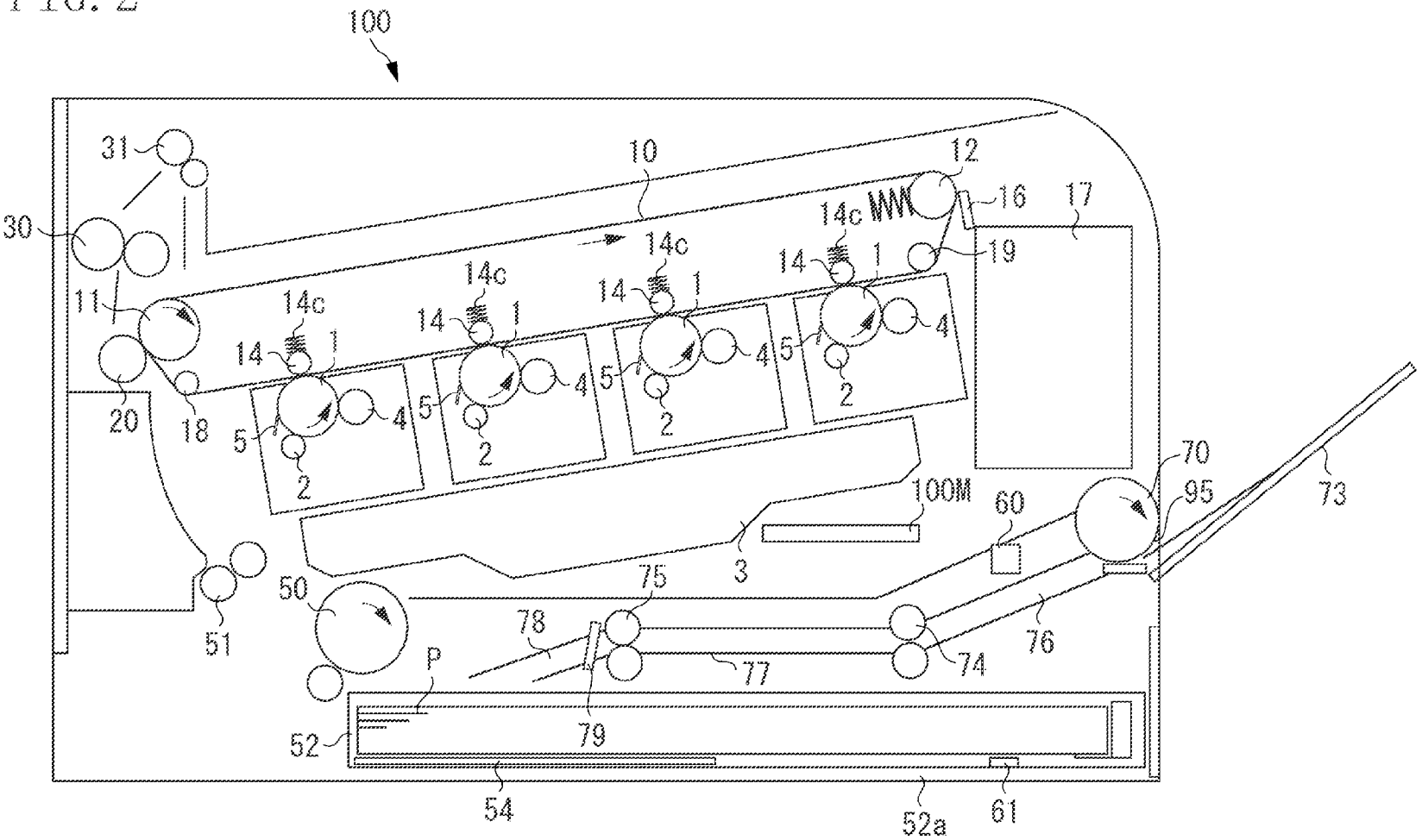
FIG. 2 is a cross-sectional view illustrating a state in which a manual feed tray is open in the image forming apparatus according to the first exemplary embodiment.

A manual feed tray 73, which is rotatable around a lower edge as the fulcrum, is disposed on a side of the image forming apparatus 100. As illustrated FIG. 2, a manual feeding unit 70, i.e., a second feeding unit, which feeds the sheets stacked on the opened manual feed tray 73, is arranged opposite the lower edge of the manual feed tray 73. Referring to FIG. 2, when the manual feed tray 73 is opened, a feed port 95 leading to inside the image forming apparatus main body becomes exposed on the side of the image forming apparatus 100. The manual feeding unit 70 separates the sheets that are stacked on the manual feed tray 73 via the feed port 95, and feeds each sheet to inside the image forming apparatus 100.

Manual feed conveyance paths 76, 77, and 78, i.e., the sheet conveyance paths for guiding the sheet fed from the manual feeding unit 70, are disposed above the sheet cassette 52 and extend in an approximately horizontal direction. Conveyance roller pairs 74 and 75 and a paper position detection flag 79 are arranged in the manual feed conveyance paths 76, 77, and 78. A sheet detection sensor 60, i.e., a detection unit for detecting the sheet conveyed on the manual feed conveyance path 76 and detecting whether there is a sheet in the sheet cassette 52, is disposed above the manual feed conveyance path 76. The configuration and the operation of the sheet detection sensor 60 will be described in detail below.

Further, the image forming apparatus 100 includes an image forming unit G, which forms an image on the sheet fed from the sheet cassette 52, i.e., the storage unit that stores the sheets, or from the manual feed tray 73. The image forming unit G includes four sets of photosensitive drums 1 and developing devices 4, an intermediate transfer belt 10 located opposite the photosensitive drums 1, a laser scanner 3 arranged below the intermediate transfer belt 10, and a fixing device 30 arranged above a nip portion formed between the intermediate transfer belt 10 and a secondary transfer roller 20.

<Feeding Sheets from the Sheet Cassette>

The feeding roller 50 feeds to the image forming unit G the sheets stacked and stored in the sheet cassette 52, one by one from the top sheet. The elevating plate 54 rotates around the fulcrum 54*a* in a clockwise direction illustrated in FIG. 1 as the number of sheets stored in the sheet cassette 52 decreases. The elevating plate 54 thus maintains the top sheet at a predetermined position appropriate for being fed by the feeding roller 50.

<Feeding Sheets from the Manual Feed Tray>

When manually feeding the sheets from the manual feed tray 73, the user opens the manual feed tray 73 to a right side of the image forming apparatus 100, and sets the sheets on the manual feed tray 73. The manual feeding unit 70 feeds via the feed port 95 the sheets stacked on the manual feed tray 73 to inside the image forming apparatus 100. The conveyance roller pairs 74 and 75 then convey the fed sheet through the manual feed conveyance paths 76, 77, and 78, and the sheet temporarily stops directly below the feeding roller 50. The position where the sheet temporarily stops is determined by stopping the rotation of the conveyance roller pairs 74 and 75 according to detection by the paper position detection flag 79 arranged downstream with respect to the conveyance roller pair 75. When a control unit 100M (illustrated in FIG. 13) in the image forming apparatus 100 outputs a signal to re-feed the sheet, the feeding roller 50 and the conveyance roller pairs 74 and 75 restart feeding the sheet.

The image forming unit G forms an image on the sheet fed from the manual feed tray 73 similarly as on the sheet fed from the sheet cassette 52.

<Image Forming Operation>

The drum-type electrophotographic photosensitive member (hereinafter referred to as a photosensitive drum) 1 is rotationally driven in a direction indicated by an arrow illustrated in FIG. 1 at a predetermined circumferential speed (process speed).

While the photosensitive drum 1 is rotated, a charging roller 2 uniformly charges the photosensitive drum 1 to predetermined polarity and potential, and the laser scanner 3, i.e., an image exposure unit, performs image exposing on the photosensitive drum 1. As a result, an electrostatic latent image corresponding to a first color (i.e., yellow) component image of a target color image is formed. The developing device 4 then develops the electrostatic latent image in a developing position, and the electrostatic latent image is made visible as a toner image.

The intermediate transfer belt 10 is an endless belt, which is stretched by stretching members (i.e., a drive roller 11, a tension roller 12, and auxiliary rollers 18 and 19). The intermediate transfer belt 10 is rotationally driven at an opposing portion in which the intermediate transfer belt 10 is in contact with the photosensitive drum 1, in the same direction and at approximately the same circumferential speed as the photosensitive drum 1.

When the toner image formed on the photosensitive drum 1 passes through a contacting portion between the photosensitive drum 1 and the intermediate transfer belt 10, the toner image is transferred (i.e., primary-transferred) to the intermediate transfer belt 10 by a primary transfer voltage applied to a primary transfer roller 14. A cleaning device 5 cleans and removes residual toner remaining on the surface of the photosensitive drum 1 after the primary transfer, and the removed toner is used in the image forming operation including the charging process and subsequent processes.

A second color (magenta) toner image, a third color (cyan) toner image, and a fourth color (black) toner image are similarly formed, and sequentially superimposed and transferred to the intermediate transfer belt 10. A combined color image corresponding to the target color image is thus acquired.

The four-color toner image on the intermediate transfer belt 10 passes through a secondary transfer nip formed between the intermediate transfer belt 10 and a secondary transfer roller 20. As a result, the four-color toner image is transferred to the surface of the sheet fed from the sheet cassette 52 via the feeding roller 50, or the sheet fed from the manual feed tray 73. More specifically, a secondary transfer power source applies a secondary transfer voltage on the secondary transfer roller 20, so that the toner image on the intermediate transfer belt 10 is collectively transferred (secondary transferred) to the surface of a sheet P. In such a case, drive timing or a conveying speed of a registration roller pair 51 is adjusted to align the toner image formed on the intermediate transfer belt 10 with the position of the sheet fed from the feeding roller 50.

The sheet P to which the four-color toner image has been transferred is introduced to the fixing device 30, and heat-pressed therein, so that the four color toners are melted and mixed, and fixed to the sheet P. As a result of the above-described operation, a full-color print image is formed. A discharge roller 31 discharges to a top surface of the apparatus the sheet on which the image has been fixed by the fixing device 30.

Further, a transfer belt cleaning device 16 cleans and removes secondary transfer residual toner remaining on the surface of the intermediate transfer belt 10, and stores the removed toner in a toner collecting container 17.

According to the present exemplary embodiment, the laser scanner 3 and the photosensitive drum 1 are arranged below the intermediate transfer belt 10 in the image forming apparatus. However, the laser scanner 3 and the photosensitive drum 1 may be arranged above the intermediate transfer belt 10 in the image forming apparatus.

<Sheet Detection Sensor 60>

Figure 3:
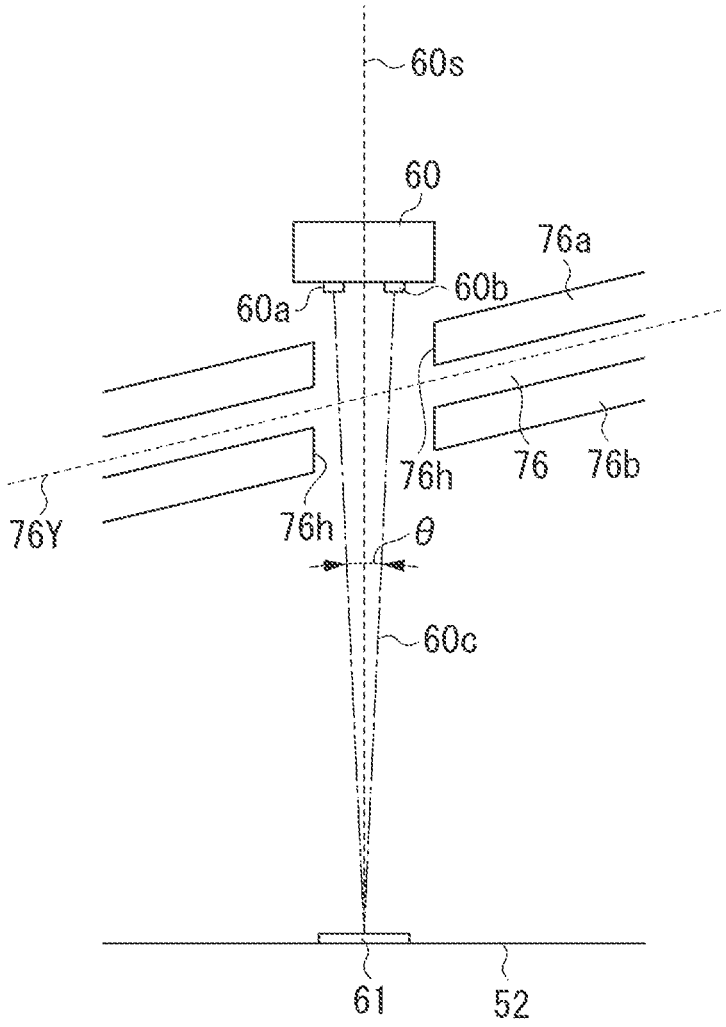
FIG. 3 illustrates a configuration of a sheet detection unit according to the first exemplary embodiment.
Figure 4:
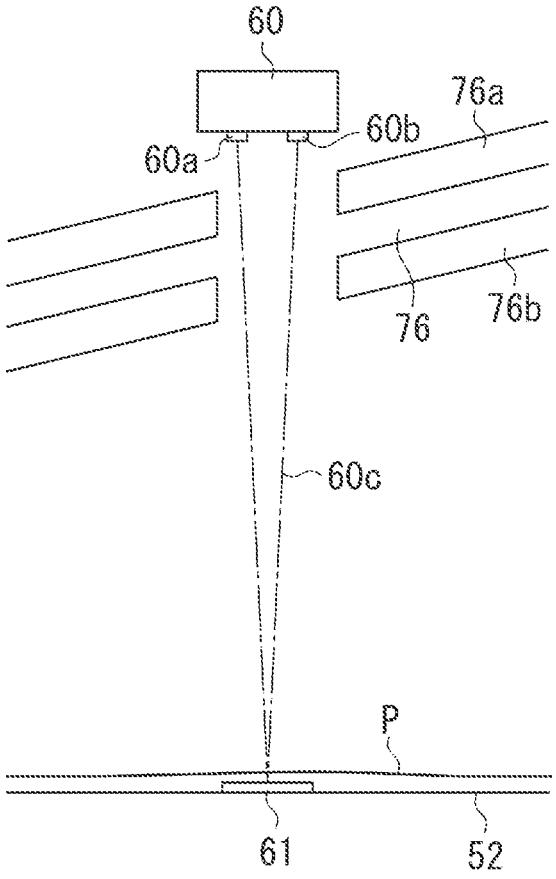
FIG. 4 illustrates detection of whether there is a sheet in a sheet cassette according to the first exemplary embodiment.
Figure 5:
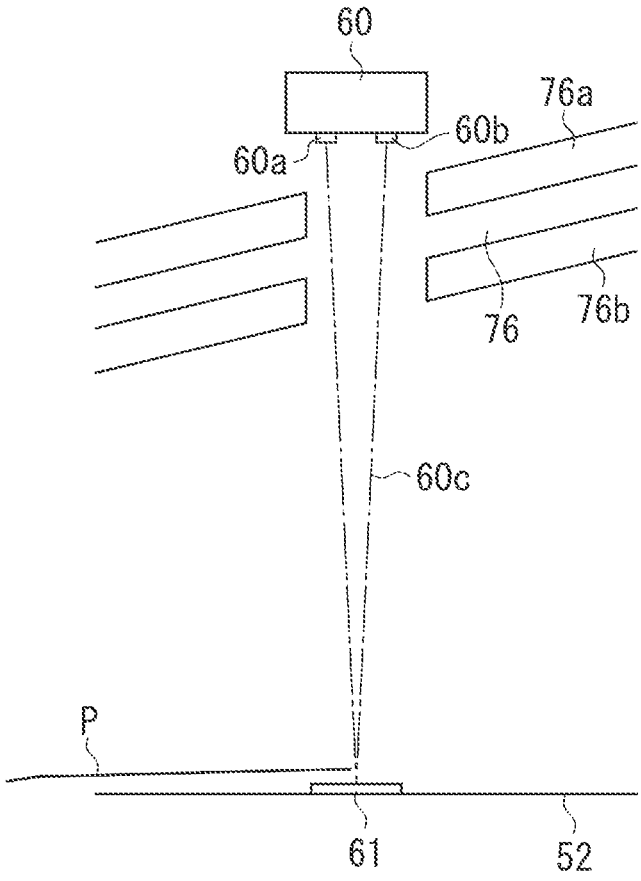
FIG. 5 illustrates detection of whether there is a sheet in the sheet cassette according to the first exemplary embodiment.
Figure 7:
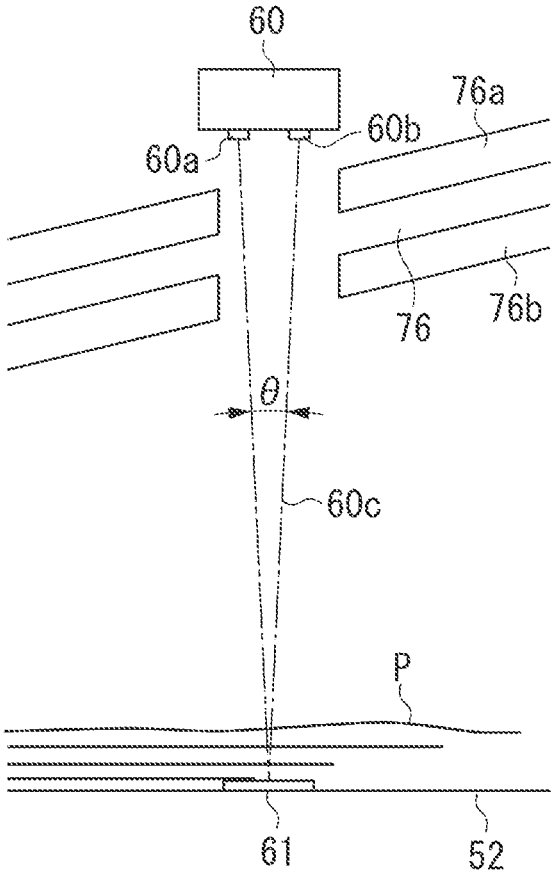
FIG. 7 illustrates detection of whether there is a sheet in a manual feed conveyance path according to the first exemplary embodiment.
Figure 8:
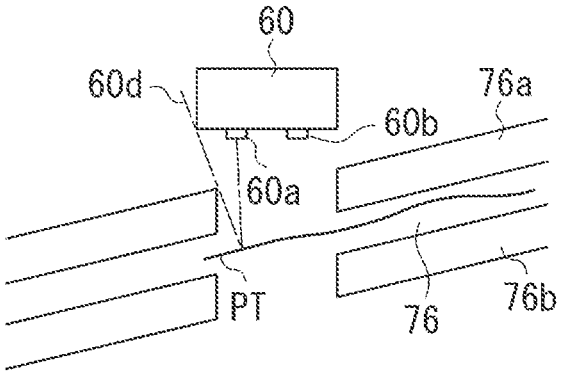
FIG. 8 illustrates detection of whether there is a sheet in the manual feed conveyance path according to the first exemplary embodiment.
Figure 8:
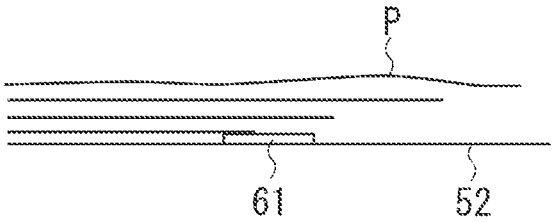

The sheet detection sensor 60, which is a detection unit that detects the sheet conveyed on the manual feed conveyance path 76 and detects whether there is a sheet in the sheet cassette 52, will be described below with reference to FIGS. 3, 4, 5, 6, 7, 8, 9, 10, and 11. FIGS. 3, 4, 5, 7, and 8 are schematic cross-sectional views illustrating the configuration and the operation of the sheet detection sensor 60. More specifically, FIG. 3 illustrates a state in which there is no sheet in the sheet cassette 52 and in the manual feed conveyance path 76. FIG. 4 illustrates a state in which there is only one sheet in the sheet cassette, and FIG. 5 illustrates a state in which the one sheet in the sheet cassette 52 is being conveyed. FIG. 7 illustrates a state in which there are sheets in the sheet cassette 52 and there is no sheet in the manual feed conveyance path 76. FIG. 8 illustrates a state in which there are sheets in the sheet cassette 52 and a sheet in the manual feed conveyance path 76.

Referring to FIG. 3, the sheet detection sensor 60 is arranged above the manual feed conveyance path 76. The sheet detection sensor 60 includes a light emitting portion 60*a*, which emits light downwards towards the sheet cassette 52, and a light receiving portion 60*b*, which receives the light from below.

The manual feed conveyance path 76 is formed of an upper guide 76*a* and a lower guide 76*b*, i.e., sheet guides. Further, a hole 76*h*, i.e., a light passage portion through which light 60*c* emitted from the sheet detection sensor 60 can pass upwards and downwards is formed in an area where the sheet is guided by the upper guide 76*a* and the lower guide 76*b*.

A reflecting plate 61 is a reflecting unit that reflects the light. The reflecting plate 61 is disposed in the area in which a sheet of a minimum size storable in the sheet cassette 52 is stacked at the bottom surface of a cassette frame 52*a* of the sheet cassette 52, on a light path from the light emitting portion 60*a* in the sheet detection sensor 60. The reflecting plate 61 reflects the light emitted from the light emitting portion 60*a* towards the light receiving portion 60*b*. As illustrated in FIG. 3, when there is no sheet in the sheet cassette 52 and the manual feed conveyance path 76, the reflecting plate 61 reflects the light emitted from the light emitting portion 60*a*, and the light receiving portion 60*b* receives the reflected light. The reflecting plated 61 is attached to a bottom plate so that the upper surface of the reflective plate 61 is approximately parallel to the bottom surface of the cassette frame 52*a* of the sheet cassette 52. The upper surface of the reflecting plate 61 and the upper surface of the top sheet stacked on the sheet cassette 52 thus become approximately parallel.

The upper guide 76*a* and the lower guide 76*b* are disposed so that a conveyance direction 76Y of the sheet guided by the upper guide 76*a* and the lower guide 76*b* becomes tilted with respect to the upper surface of the reflecting plate 61. According to the present exemplary embodiment, the upper guide 76*a* and the lower guide 76*b* are disposed so that the conveyance direction 76Y is tilted by 18° with respect to the upper surface of the reflecting plate 61. As a result, the sheet fed from the manual feed tray 73 is guided between the upper guide 76*a* and the lower guide 76*b* in a tilted orientation with respect to the upper surface of the reflecting plate 61. Since the upper surface of the reflecting plate 61 and the upper surface of the top sheet stacked on the sheet cassette 52 are approximately parallel, the sheet guided between the upper guide 76*a* and the lower guide 76*b* becomes tilted with respect to the upper surface of the top sheet stacked on the sheet cassette 52.

The upper surface of the reflecting plate 61 is perpendicular to an optical axis 60S, which is a line connecting the sheet detection sensor 60 and the reflecting plate 61. The optical axis 60S is a line which passes through the sheet detection sensor 60 and which is perpendicular to the reflecting plate 61. If sensor light is emitted from the light emitting portion 60*a* and specularly-reflected by the reflecting plate 61 towards the light receiving portion 60*b* (i.e., travels on a specular reflection light path), the following occurs. The light emitted from the light emitting portion 60*a* to the reflecting plate 61 and the light reflected by the reflecting plate 61 to the light receiving portion 60*b* pass through symmetrical positions with respect to the optical axis 60S. According to the present exemplary embodiment, an angle θ which is 15° is formed between the light emitted from the light emitting portion 60*a* to the reflecting plate 61 and the light reflected by the reflecting plate 61 to the light receiving portion 60*b* in the specular reflection light path.

As illustrated in FIGS. 1 and 2, the sheet detection sensor 60, the sheet cassette 52, and the reflecting plate 61 are arranged so that the sensor light emitted from the light emitting portion 60*a* irradiates, among the sheets stored in the sheet cassette 52, a trailing edge portion of the sheet not supported by the elevating plate 54. According to the present exemplary embodiment, the position which the sheet detection sensor 60 irradiates in a sheet conveyance direction of the sheet cassette is set as follows. When the sheet cassette 52 is loaded in the apparatus main body and B5-size sheets, which are the minimum size sheets storable in the sheet cassette 52, are set in the sheet cassette 52, the position which the sheet detection sensor 60 irradiates with the sensor light is arranged to be approximately 5 mm downstream from an upstream edge of the B5-size sheet.

Figure 13:
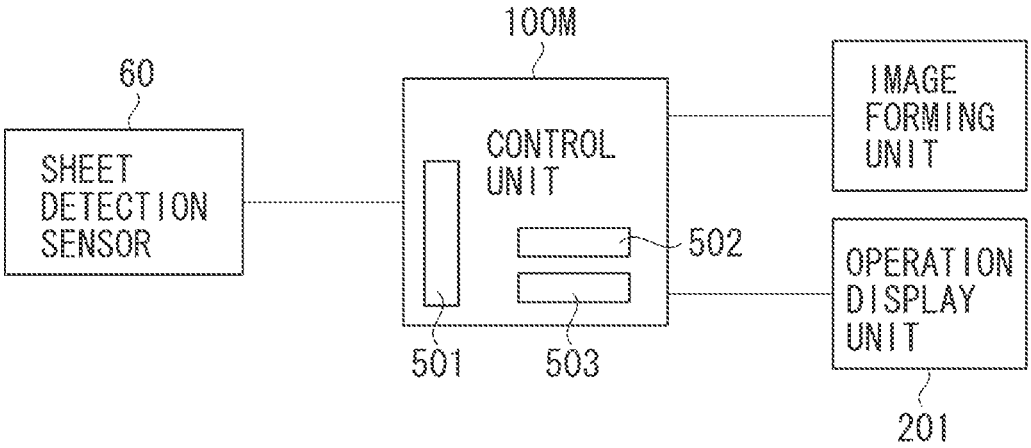
FIG. 13 illustrates a control block diagram according to the first exemplary embodiment.

FIG. 13 illustrates a control block diagram according to the present exemplary embodiment. Referring to FIG. 13, the sheet detection sensor 60 is connected to the control unit 100M, which controls the image forming apparatus 100. The control unit 100M determines, based on an amount of light received by the light receiving portion 60*b* in the sheet detection sensor 60, whether there is a sheet in the sheet cassette 52 and in the manual feed conveyance path 76. The control unit 100M controls the operations of each unit in the image forming unit G and an operation display unit 201. The control unit 100*m* includes a central processing unit (CPU) 501, a read-only memory (ROM) 502 storing programs, and a random access memory (RAM) 503 used as a work memory when executing the programs stored in the ROM 502.

<Detection of a Sheet by the Sheet Detection Sensor 60>

(A) Detection of Whether there is a Sheet in the Sheet Cassette 52

Detection of whether there is a sheet stored in the sheet cassette 52 will be described below with reference to FIGS. 4 and 5.

Referring to FIG. 4, only one A4-size sheet P is in the sheet cassette 52, and there is no sheet in the manual feed conveyance path 76. In such a case, the sensor light emitted from the light emitting portion 60*a* is reflected on the upper surface of the sheet P in the sheet cassette 52, and the light receiving portion 60*b* receives the reflected light.

On the other hand, FIG. 5 illustrates a state in which the trailing edge of sheet P has passed the reflecting plate 61 after the state illustrated in FIG. 4. In such a case, the sensor light emitted from the light emitting portion 60*a* is reflected by the reflecting plate 61, and the light receiving portion 60*b* receives the reflected light (i.e., the same state as illustrated in FIG. 3).

Figure 6:
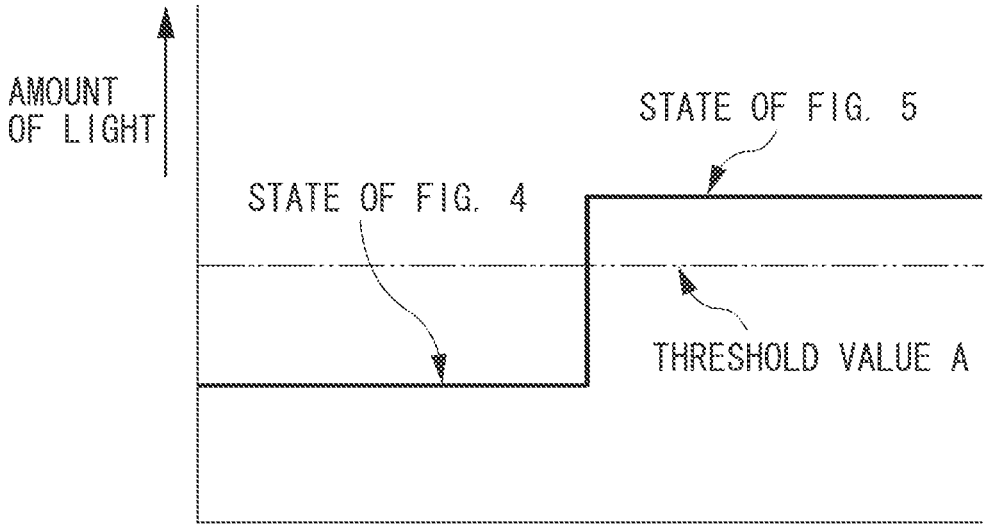
FIG. 6 illustrates an output from a sheet detection sensor according to the first exemplary embodiment.

FIG. 6 illustrates a change in the amount of light received by the sheet detection sensor 60 when the state shifts from the state illustrated in FIG. 4 to that in FIG. 5. Referring to FIG. 6, after the trailing edge of the sheet P passes through the reflected light path 60*c*, the sheet detection sensor 60 switches from a state of receiving the reflected light from the sheet P to the state of receiving the reflected light from the reflecting plate 61. The amount of light received by the sheet detection sensor 60 thus increases. If the amount of received light is greater than a preset threshold value A (i.e., a first predetermined value), the control unit 100M in the image forming apparatus 100 determines that there is no sheet in the sheet cassette 52. The control unit 100M thus stops, based on the determination result, the image forming operation with respect to the subsequent sheet. The control unit 100M then notifies, using the operation display unit 201, the user that there is no sheet in the sheet cassette 52. As described above, the control unit 100M determines whether there is a sheet in the sheet cassette 52 based on the amount of light received by the light receiving portion 60*b* in the sheet detection sensor 60.

(B) Detection of a Sheet in the Manual Feed Conveyance path 76

(B-1) The method for detecting a sheet in the manual feed conveyance path 76 in the case where there is a sheet P in the sheet cassette 52 will be described below with reference to FIGS. 7 and 8.

FIG. 7 illustrates a state in which there is the sheet P in the sheet cassette 52, and there is no sheet in the manual feed conveyance path 76. In such a case, the sensor light emitted from the light emitting portion 60*a* is reflected by the upper surface of the sheet P in the sheet cassette 52, and the light receiving portion 60*b* receives the reflected light.

On the other hand, FIG. 8 illustrates the state in which there is a sheet PT in the manual feed conveyance path 76, blocking a reflecting light path 60*c*. In such a case, the sensor light emitted from the light emitting portion 60*a* is reflected by the sheet PT guided between the upper guide 76*a* and the lower guide 76*b* in the manual feed conveyance path 76, and the light receiving portion 60*b* receives the reflected light.

Figure 9:
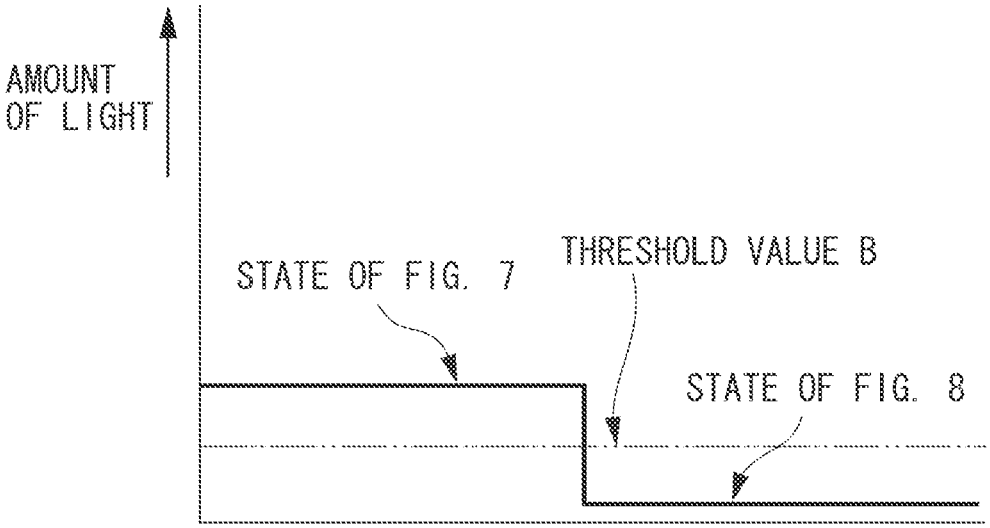
FIG. 9 illustrates an output from the sheet detection sensor according to the first exemplary embodiment.

FIG. 9 illustrates a change in the amount of light received by the sheet detection sensor 60 when the state shifts from the state illustrated in FIG. 7 to that in FIG. 8. Referring to FIG. 9, when the leading edge of the sheet PT passes through the reflected light path 60*c*, the sheet detection sensor 60 switches from the state of receiving the reflected light from the sheet P in the sheet cassette 52 to the state of receiving the reflected light from the sheet PT in the manual feed conveyance path 76. The amount of received light thus decreases.

In such a case, if the amount of received light becomes less than a preset threshold value B (i.e., a second predetermined value), the control unit 100M in the image forming apparatus 100 determines that the sheet PT is in the manual feed conveyance path 76.

The sheet in the manual feed conveyance path 76 is detected for detecting a conveyance delay jam in the manual feeding unit 70 or a jam caused by the sheet PT remaining in the manual feed conveyance path 76. In other words, the control unit 100M controls the image forming apparatus as follows based on the result of determining whether there is a sheet in the manual feed conveyance path 76. For example, if the sheet PT conveyed by the manual feeding unit 70 does not reach the sheet detection sensor 60 in a predetermined time, the control unit 100M notifies the user of the jam, and stops the image forming operation on the photosensitive drum 1. Further, if the sheet PT to be conveyed by the feeding roller 50 continues to remain below the sheet detection sensor 60 after a predetermined time has elapsed in the case where the feeding roller 50 conveys the sheet PT in the manual feed conveyance path 76 downstream, the control unit 100M notifies the user of the jam, and stops the image forming operation.

When the sheet detection sensor 60 switches from the state of receiving the light reflected by the sheet P on the sheet cassette 52 to the state of receiving the light reflected by the sheet PT on the manual feed conveyance path 76, the amount of received light decreases for the following reason. According to the present exemplary embodiment, the manual feed conveyance path 76 is arranged to be tilted with respect to the optical axis 60 connecting the sheet detection sensor 60 and the reflecting plate 61. As a result, the specularly-reflected light among the reflected light from the sheet PT is reflected in a direction 60*d* illustrated in FIG. 8, so that the light-receiving portion 60*b* cannot receive the specularly-reflected light and thus only receives diffusely-reflected light. Since the light-receiving portion 60*b* does not receive the specularly-reflected light, the amount of light received by the sheet detection sensor 60 greatly decreases.

According to the present exemplary embodiment, the manual feed conveyance path 76 is arranged to be tilted by 18° with respect to the reflecting plate 61. However, it is not limited thereto, as long as the manual feed conveyance path 76 is arranged to be tilted with respect to the reflecting plate 61 by an angle greater than the angle θ formed by the specularly-reflected light path of the sheet detection sensor 60 (15° according to the present exemplary embodiment), so that the specularly-reflected light moves away from the light receiving portion 60*b*.

(B-2) The method for detecting a sheet in the manual feed conveyance path 76 in the case where there is no sheet P in the sheet cassette 52 will be described below with reference to FIGS. 10 and 11.

Figure 10:
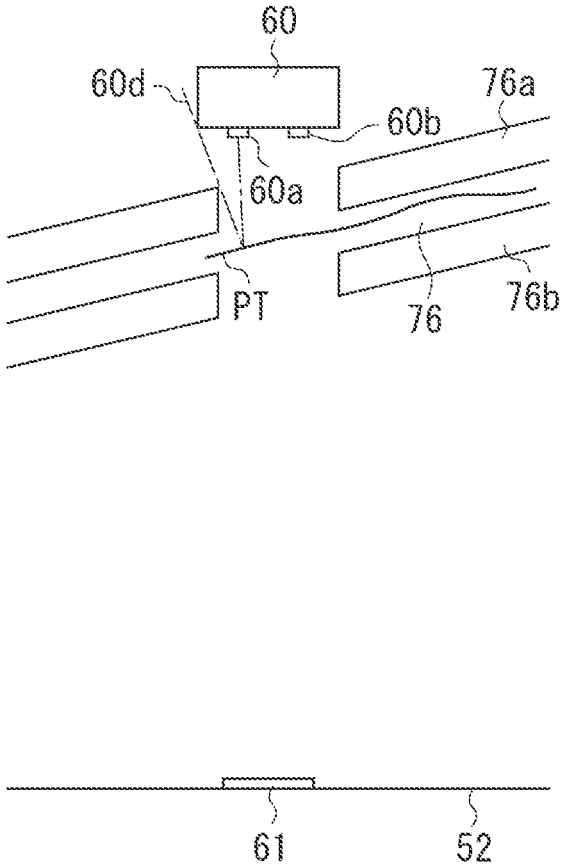
FIG. 10 illustrates detection of whether there is a sheet in the manual feed conveyance path according to the first exemplary embodiment.
Figure 11:
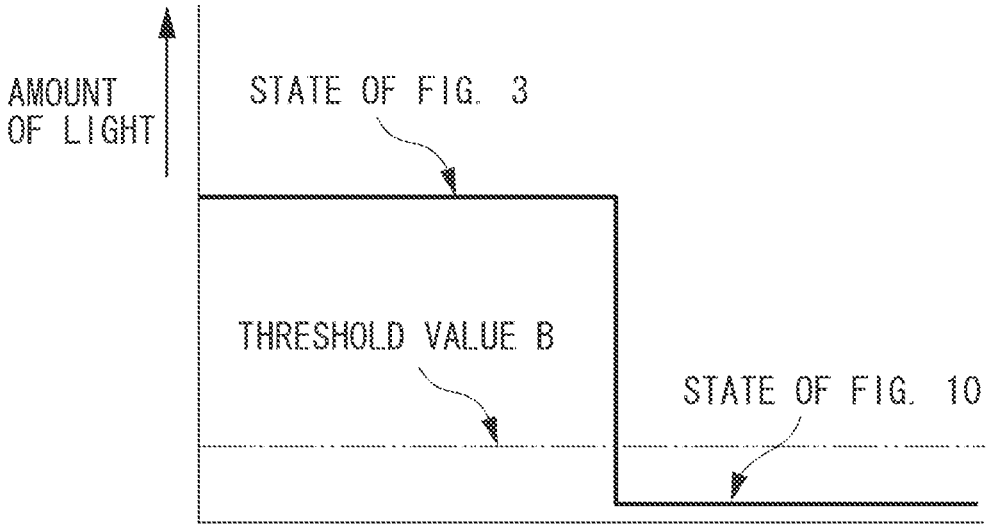
FIG. 11 illustrates an output from the sheet detection sensor according to the first exemplary embodiment.

FIG. 10 illustrates a state in which there is no sheet P in the sheet cassette 52, and there is the sheet PT in the manual feed conveyance path 76, blocking the reflecting light path 60*c*. FIG. 11 illustrates a change in the amount of light received by the sheet detection sensor 60 when the state shifts from the state illustrated in FIG. 3 to that in FIG. 10. Referring to FIG. 11, whether there is a sheet is determined using a threshold value B similarly as illustrated in FIG. 9. Since the jam determination and processing performed based on determining whether there is a sheet are similar to those illustrated in FIG. 9, the description will be omitted.

As described above, the control unit 100M determines whether there is a sheet in the manual feed conveyance path 76 based on the amount of light received by the light receiving portion 60*b* in the sheet detection sensor 60.

<Sheet Detection Process>

Figure 14:
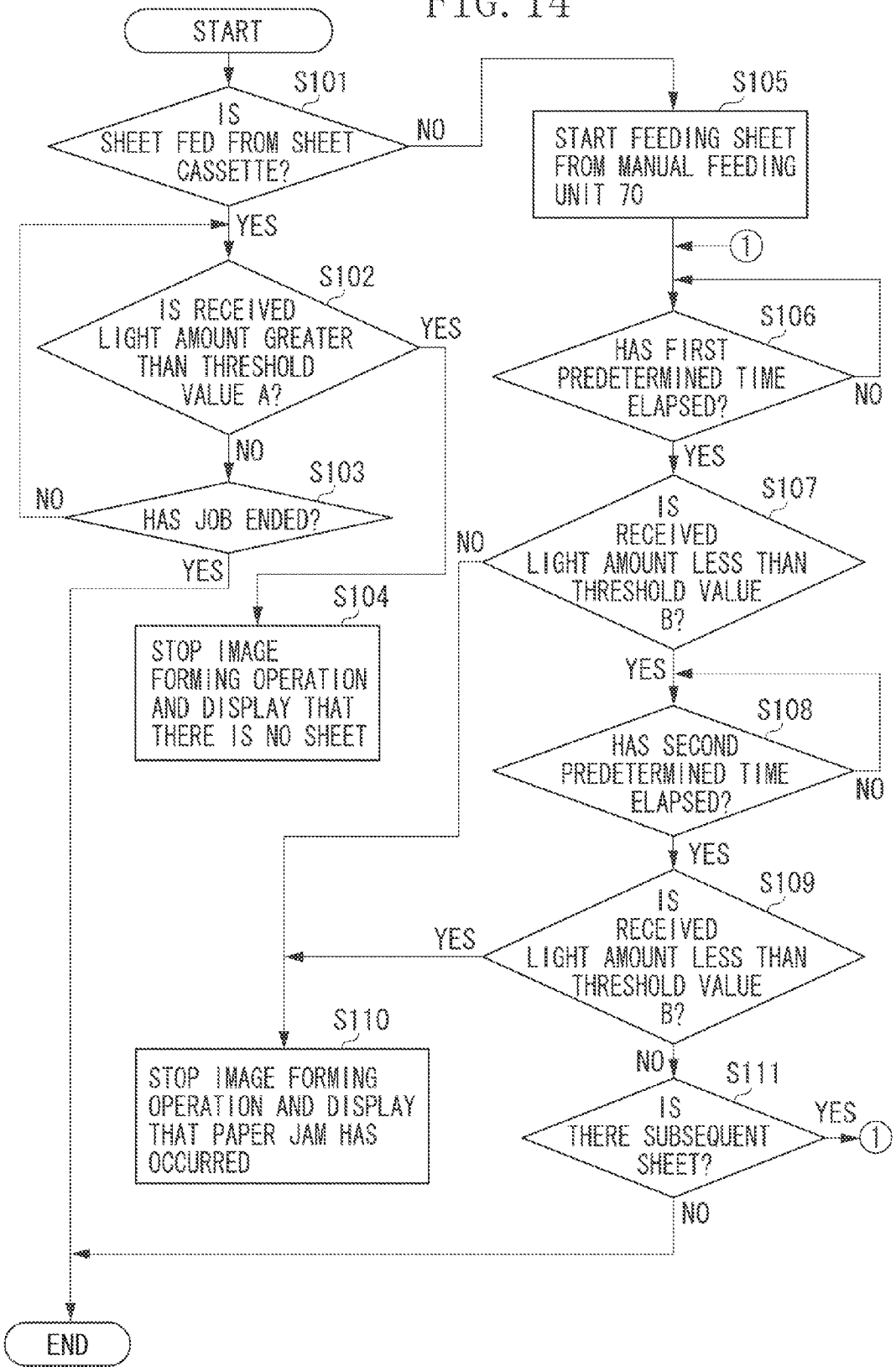
FIG. 14 is a flowchart illustrating control performed for detecting whether there is a sheet according to the first exemplary embodiment.

The process for detecting whether there is a sheet in the sheet cassette 52 and in the manual feed conveyance path 76 based on the control block diagram illustrated in FIG. 13 will be described below with reference to FIG. 14. The process to be described below is realized by the CPU 501 executing the program stored in the ROM 502.

In step S101, the control unit 100M determines whether a sheet is fed from the sheet cassette 52. More specifically, the control unit 100M determines whether the sheet is fed from the sheet cassette 52 according to a user input to the operation display unit 201, or from the manual feed tray 73. In addition, an open/close sensor which detects an open/close state of the manual feed tray 73 may be provided. In such a case, if the open/close sensor detects that the manual feed tray 73 is closed, the control unit 100M determines that the sheet is fed from the sheet cassette 52. Further, a set sensor which detects whether there is a sheet set on the manual feed tray 73 may be provided. In such a case, if the set sensor detects that the sheet is set on the manual feed tray 73, the control unit 100M determines that the sheet is not fed from the sheet cassette 52.

If the control unit 100M determines that the sheet is fed from the sheet cassette 52 (YES in step S101), the process proceeds to step S102. In step S102, the control unit 100M determines whether the amount of light received by the light receiving portion 60*b* in the sheet detection sensor 60 is greater than the threshold value A. If the amount of light received by the light receiving portion 60*b* is greater than the threshold value A (YES in step S102), the control unit 100M determines that there is no sheet in the sheet cassette 52. In such a case, the process proceeds to step S104. In step S104, the control unit 100M controls the image forming unit G to stop the image forming operation with respect to the photosensitive drum 1, and displays on the operation display unit 201 that there is no sheet. If the amount of light received by the light receiving portion 60*b* is not greater than the threshold value A (NO in step S102), the process proceeds to step S103. In step S103, the control unit 100M determines whether the image forming job has ended. If the job has ended (YES in step S103), the process ends. If the job has not ended (NO in step S103), the process returns to step S102.

If the control unit 100M determines that the sheet is not fed from the sheet cassette 52 (NO in step S101), the process proceeds to step S105. In step S105, the control unit 100M causes the manual feeding unit 70 to feed the sheet from the manual feed tray 73. In step S106, the control unit 100M determines whether a first predetermined time has elapsed from when the manual feeding unit 70 has started feeding the sheet.

If the first predetermined time has elapsed (YES in step S106), the process proceeds to step S107. In step S107, the control unit 100M determines whether the amount of light received by the light receiving portion 60*b* in the sheet detection sensor 60 is less than the threshold value B. According to the present exemplary embodiment, the first predetermined time is set as the time between when the manual feeding unit 70 has started feeding the sheet and when the sheet reaches a detecting position of the sheet detection sensor 60. The first predetermined time is set based on the distance from the manual feeding unit 70 to the sheet detection sensor 60 and the sheet conveying speed. If the amount of light received by the light receiving portion 60*b* is not less than the threshold value B (NO in step S107), the process proceeds to step S110. In step S110, the control unit 100M stops the image forming operation of the image forming unit G and displays on the operation display unit 201 that a paper jam has occurred. If the amount of light received by the light receiving portion 60*b* is not less than the threshold value B when the first predetermined time has elapsed, it indicates that the sheet fed from the manual feeding unit 70 has not reached the sheet detection sensor 60. It is thus determined that the paper jam has occurred while the sheet is being conveyed.

If the control unit 100M determines that the amount of light received by the light receiving portion 60*b* in the sheet detection sensor 60 is less than the threshold value B when the first predetermined time has elapsed from the manual feeding unit 70 starting to feed the sheet (YES in step S107), the process proceeds to step S108. In step S108, the control unit 100M determines whether a second predetermined time has elapsed from when causing the manual feeding unit 70 to start feeding the sheet.

If the second predetermined time has elapsed (YES in step S108), the process proceeds to step S109. In step S109, the control unit 100M determines whether the amount of light received by the light receiving portion 60*b* in the sheet detection sensor 60 is less than the threshold value B. According to the present exemplary embodiment, the second predetermined time is set as the time between when the manual feeding unit 70 has started feeding the sheet and when the trailing edge of the sheet passes the detecting position of the sheet detection sensor 60. The second predetermined time is set based on the distance from the manual feeding unit 70 to the sheet detection sensor 60, the sheet conveying speed, and a sheet size (i.e., the length of the sheet in the sheet feed direction). If the control unit 100M determines that the amount of light received by the light receiving portion 60*b* is less than the threshold value B (YES in step S109), the process proceeds to step S110. In step S110, the control unit 100M stops the image forming operation of the image forming unit G and displays on the operation display unit 201 that a paper jam has occurred. If the amount of light received by the light receiving portion 60*b* is less than the threshold value B when the second predetermined time has elapsed, it indicates that the sheet to be conveyed downstream and to pass the sheet detection sensor 60 continues to remain in the detecting position. It is thus determined that a paper jam has occurred while the sheet is being conveyed.

If the control unit 100M determines that the amount of light received by the light receiving portion 60*b* is not less than the threshold value B (NO in step S109), the process proceeds to step S111. In step S111, the control unit 100M determines whether the subsequent sheet is present on the manual feed tray 73. If the subsequent sheet is present on the manual feed tray 73 (YES in step S111), the process returns to step S105. If there is no subsequent sheet (NO in step S111), the process ends.

<Advantageous Effects of the Present Exemplary Embodiment>

(1) One common sheet detection sensor 60 detects whether there is a sheet in the sheet cassette 52 and whether there is a sheet in the manual feed conveyance path 76. A low-cost and compact image forming apparatus can thus be provided as compared to a configuration in which the sheet detection sensors are separately included.

(2) A light-reflecting sensor is employed as the sheet detection sensor 60. As a result, as compared to employing a flag-type sensor using a sensor flag that rotates by being pressed by the sheet, the space for turning the sensor flag becomes unnecessary, so that a compact apparatus can be provided.

(3) Whether a sheet is present in the sheet cassette can be more promptly detected as compared to a comparative example to be described below with reference to FIG. 18. Wasteful consumption of the toner can thus be reduced, and the toner collecting container can be downsized, resulting in a decrease in the size and cost of the apparatus main body. The reduction of wasteful toner consumption by the image forming apparatus according to the present exemplary embodiment will be described below.

Figure 12:
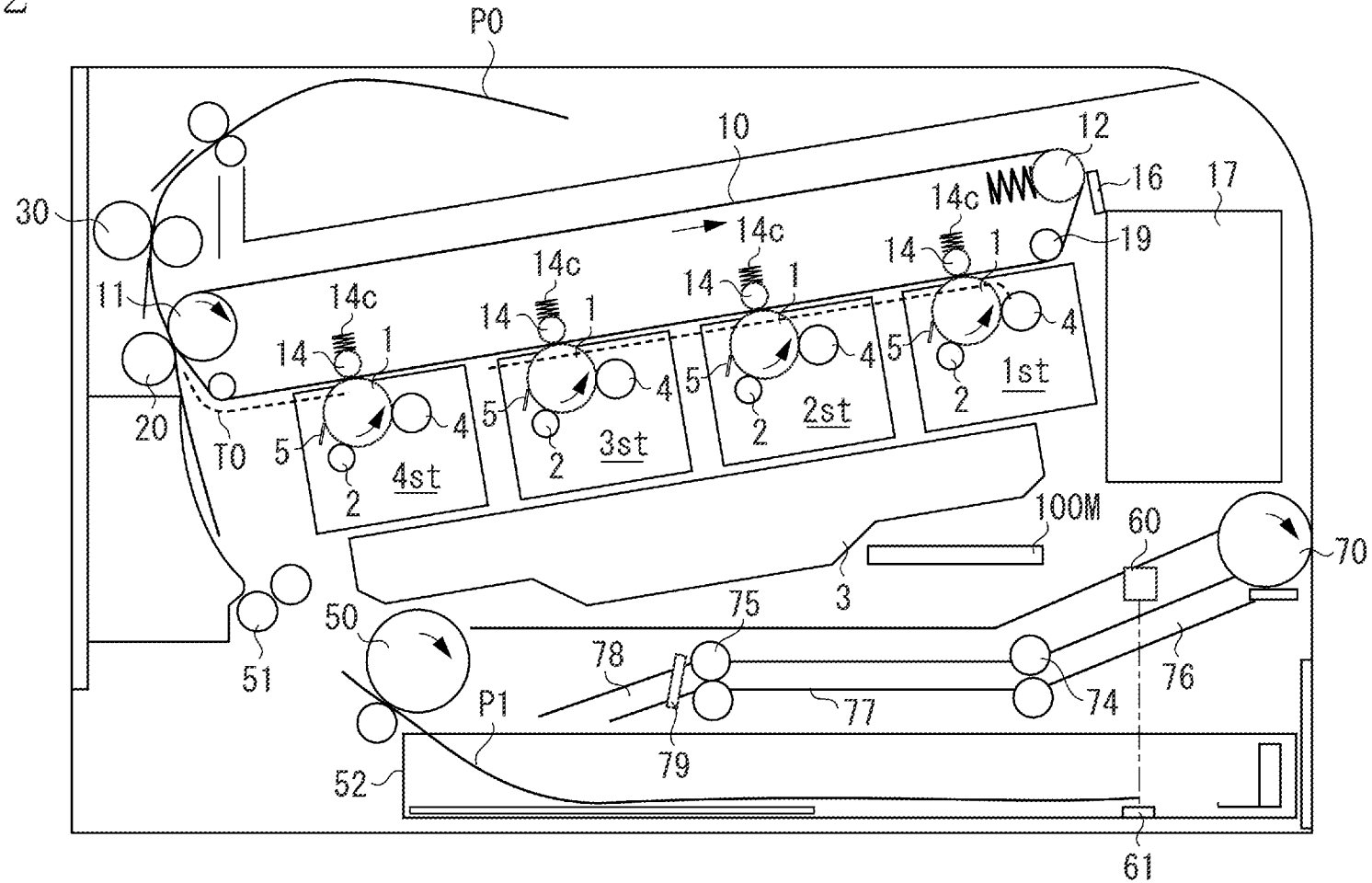
FIG. 12 illustrates a state in which the last sheet is conveyed from the sheet cassette in the image forming apparatus according to the first exemplary embodiment.

FIG. 12 illustrates the last sheet being conveyed from the sheet cassette 52 in the image forming apparatus according to the present exemplary embodiment. FIG. 18 illustrates the last sheet being conveyed from the sheet cassette 52 in the image forming apparatus according to a comparative example.

Figure 18:
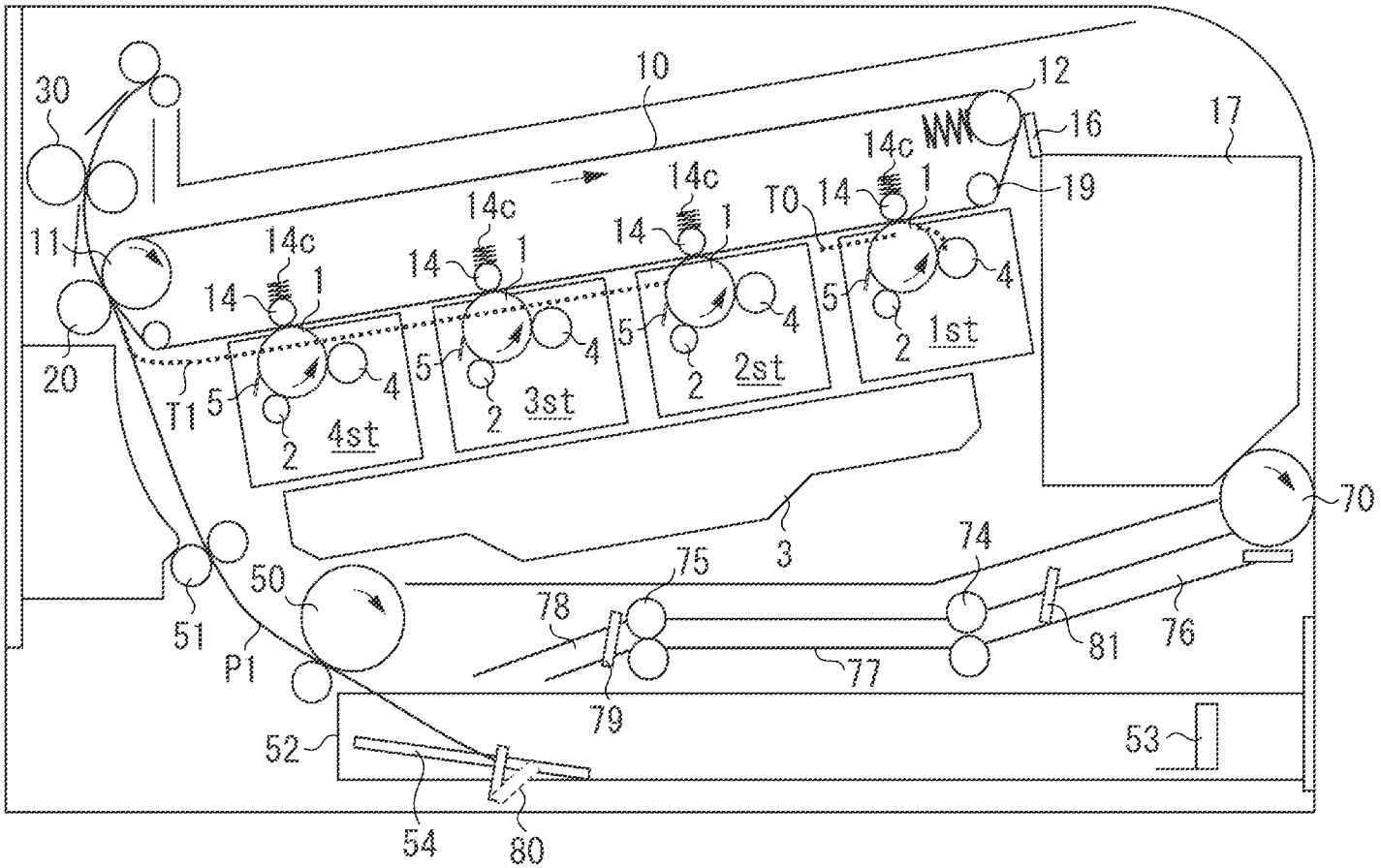
FIG. 18 is a cross-sectional view illustrating conveying of the last sheet from the sheet cassette in the image forming apparatus according to a comparative example.

In both FIGS. 12 and 18, dotted lines illustrated near the intermediate transfer belt 10 and the photosensitive drum 1 indicate the toner before the secondary transfer. Referring to FIG. 12, the trailing edge of a sheet fed from the sheet cassette 52 has passed the reflecting plate 61, and the sheet detection sensor 60 detects that there is no sheet in the sheet cassette 52. Further, toner T0 to be secondary-transferred to a preceding sheet P0, and toner T1, at an image interval from the toner T0, to be secondary-transferred to a sheet P1, are primary-transferred on the intermediate transfer belt 10. When the sheet detection sensor 60 detects that there is no sheet, the image forming operation on the photosensitive drum 1 with respect to the sheet P1 is not yet completed. In other words, when the sheet detection sensor 60 detects that there is no sheet, the image forming operation on the photosensitive drum 1 with respect to the sheet subsequent to the sheet P1 has not yet been started. In such a state, the control unit 100M can acquire the information that there is no sheet. The image forming operation on the photosensitive drum 1 with respect to the sheet subsequent to the sheet P1 is thus not performed until the sheet is set (replenished) in the sheet cassette 52. As a result, it can be detected that there is no sheet in the sheet cassette 52 before starting the image forming operation on the photosensitive drum 1 with respect to the sheet subsequent to the sheet P1, so that wasteful toner consumption can be reduced.

On the other hand, when the control unit 100M determines that there is a paper jam due to delayed sheet feeding from the manual feed tray, or a sheet run-out jam on the manual feed tray, the image forming operation is not yet started. As a result, wasteful toner consumption is prevented similarly as in the case where the sheet cassette 52 feeds the sheet.

The comparative example will be described below with reference to FIG. 18. Referring to FIG. 18, the last sheet is being conveyed from the sheet cassette 52 similarly as in FIG. 12. According to the present comparative example, a sensor flag 80, which is rotatable by being pressed by the fed sheet, and a photo sensor (not illustrated) are employed to detect whether there is a sheet. The sensor flag 80 is arranged below the elevating plate 54, which vertically moves the sheet. Since it is difficult to arrange the movable sensor flag 80 at a position near a movable range of a trailing edge regulating member 53, which regulates the trailing edge of the sheet, the sensor flag 80 is arranged as described above. Further, the sensor flag 80 is arranged below the elevating plate 54, which vertically moves the sheet when feeding the sheet, so that the space below the sheet cassette 52 which is only used as the movable range of the sensor flag 80 can be minimized.

According to the present comparative example, whether there is a sheet is detected using the leading edge of the sheet, based on the movement of the sensor flag 80. As a result, when the sensor flag 80 detects that there is no sheet, the image forming operation on the photosensitive drum 1 with respect to the sheet P1 is completed, and the image forming operation on the photosensitive drum 1 with respect to the sheet subsequent to the sheet P1 is being performed. In such a state, the control unit acquires the information that there is no sheet, and stops the image forming operation for the sheet subsequent to the sheet P1. According to the comparative example, the toner is thus wasted every time the last sheet in the sheet cassette is detected. Further, when the sheet is manually fed, a manual feed sensor 81 is separately arranged so that throughput is not greatly reduced, and the toner is not wasted due to the paper run-out jam.

Modification Examples

The image forming apparatus according to the modification examples of the present invention will be described below with reference to FIGS. 15, 16, and 17. Only the portions different from the first exemplary embodiment will be described below, and the configurations similar to that of the first exemplary embodiment will be assigned the same reference numerals and the description thereof will be omitted.

Figure 15:
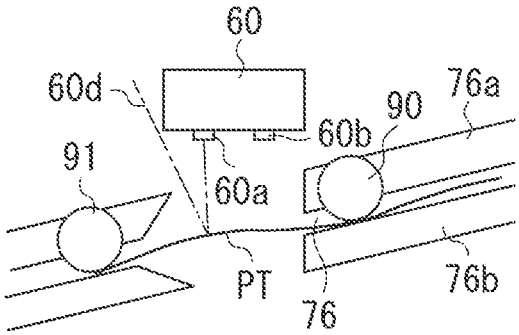
FIG. 15 illustrates detection of whether there is a sheet according to a first modification example.
Figure 15:
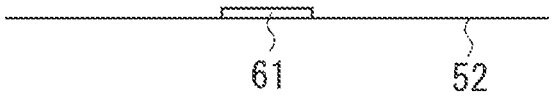
Figure 16:
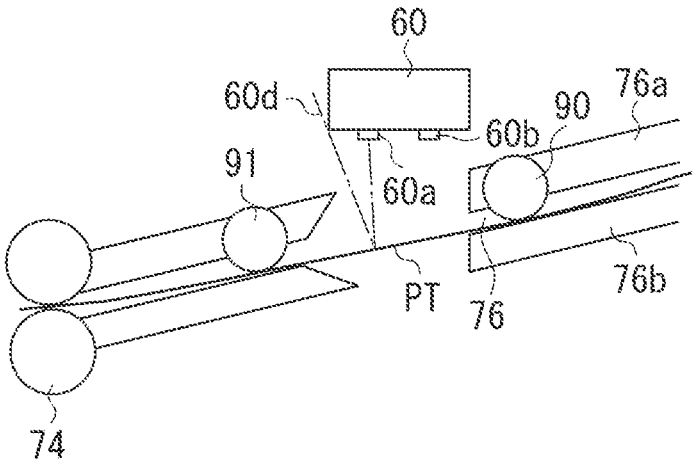
FIG. 16 illustrates detection of whether there is a sheet according to the first modification example.
Figure 16:
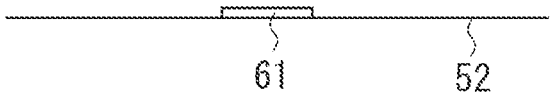

FIGS. 15 and 16 illustrate the configuration of the manual feed conveyance path 76 and the sheet conveying state according to a first modification example. According to the above-described exemplary embodiment, the manual feed conveyance path 76 is arranged to be tilted with respect to the optical axis 60*c*. The specularly-reflected light reflected by the sheet PT is thus reflected in the direction 60*d*, and the specularly-reflected light amount is not input to the light receiving portion 60*b*, so that the amount of light received by the sheet detection sensor 60 is reduced. According to the first modification example, the attitude of the sheet in the manual feed conveyance path 76 is stabilized, so that the specularly-reflected light from the sheet in the manual feed conveyance path 76 is more surely prevented from being input to the light receiving portion 60*b*.

According to the present modification example, conveyance assist rollers 90 and 91 are arranged in the manual feed conveyance path 76 as pressing units for pressing the sheet onto the lower guide 76*b*. The conveyance assist rollers 90 and 91 are arranged near the position where the light emitting portion 60*a* irradiates the sheet conveyed on the manual feed conveyance path 76 with light. The conveyance assist rollers 90 and 91 are biased toward the lower guide 76*b* by springs (not illustrated), and press the sheet onto the lower guide 76*b*. The sheet conveying speed of the conveyance roller pair 74 is set to be higher than the sheet conveying speed of the manual feeding unit 70.

FIG. 15 illustrates the leading edge of the sheet PT conveyed in the manual feed conveyance path 76 entering the conveyance assist roller 91. As the sheet PT is conveyed by the conveyance roller pair 74, the sheet PT is pulled by the conveyance roller pair 74, so that the sheet PT is stretched between the conveyance assist rollers 90 and 91. The attitude of the sheet PT thus becomes stable as illustrated in FIG. 16.

Figure 17:
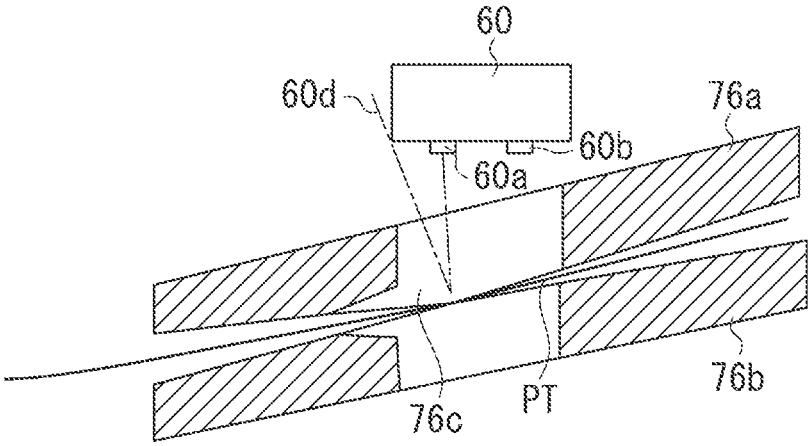
FIG. 17 illustrates detection of whether there is a sheet according to a second modification example.

Further, FIG. 17 illustrates a second modification example. The manual feed conveyance path 76 is formed by the upper guide 76*a* and the lower guide 76*b*. Referring to FIG. 17, a projecting portion 76*c* is disposed instead of the conveyance assist rollers 90 and 91. The projecting portion 76*c* is disposed so that a path interval of the manual feed conveyance path 76 (the gap between the upper guide 76*a* and the lower guide 76*b*) becomes partially narrow, i.e., becomes narrow as compared to other areas. Further, the projection portion 76*c* stabilizes the attitude of the sheet PT.

According to the above-described exemplary embodiment, the upper guide 76*a* and the lower guide 76*b* are arranged so that the surface of the sheet in the manual feed conveyance path 76 becomes tilted with respect to the upper surface of the sheet in the sheet cassette 52. By such an arrangement, the angle of the light reflected by the sheet in the sheet cassette 52 and the angle of the light reflected from the sheet in the manual feed conveyance path become different, so that the sheet in the manual feed conveyance path 76 is surely detected. A sensor capable of detecting whether the light is reflected by the sheet in the manual feed conveyance path 76 or in the sheet cassette 52 based on a difference in a loss of light amount due to the optical path length difference in the sensor light may also be employed.

According to the above-described exemplary embodiment, the reflecting plate 61 is disposed on the bottom surface of the cassette frame 52*a* of the sheet cassette 52. However, the reflecting plate may be disposed below the storage unit (i.e., a storing space) which stores the sheets. For example, an opening may be formed on the bottom surface of the cassette frame 52*a*, and the reflecting plate may be disposed at a position facing the opening in a lower portion of a chassis of the image forming apparatus main body. Further, according to the above-described exemplary embodiment, the light passage portion which allows the light from the sheet detection sensor 60 to pass through is formed by the hole 76*h* disposed in the upper guide 76*a* and the lower guide 76*b*. However, a transparent portion may be disposed in the upper guide and the lower guide as the light passage portion through which the light can pass.

Figure 19:
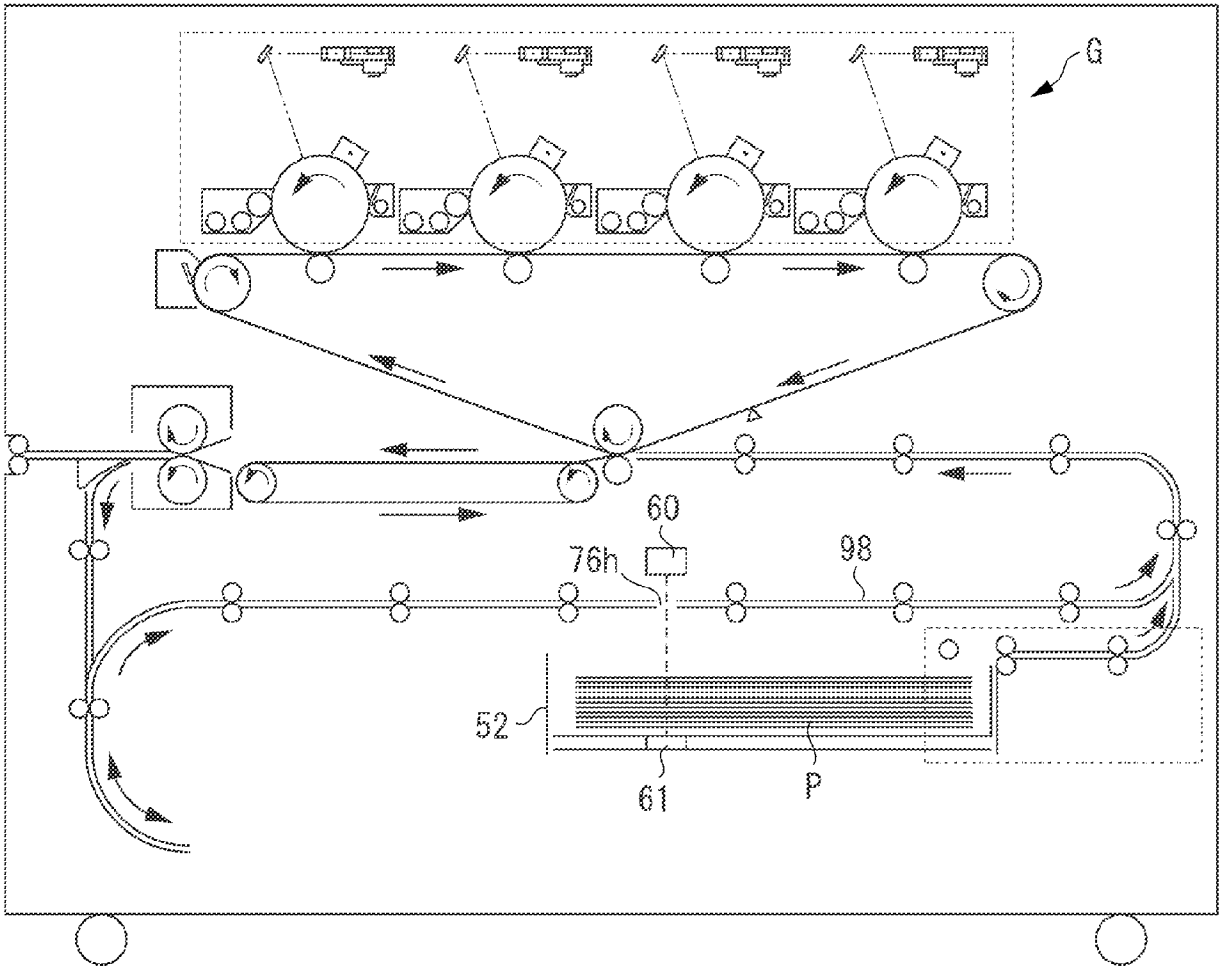
FIG. 19 is a cross-sectional view illustrating an image forming apparatus according to a second exemplary embodiment of the present invention.

A second exemplary embodiment of the present invention will be described below with reference to FIG. 19. According to the first exemplary embodiment, the sheet detection sensor 60 is disposed above the manual feed conveyance path 76. According to the second exemplary embodiment, the sheet detection sensor 60 is disposed in a re-feed conveyance path 98. Since the position of the sheet detection sensor 60 is only a difference between the second exemplary embodiment and the first exemplary embodiment, the difference will be described below, and the description on the other portions will be omitted.

If the image forming unit G is to form an image on a second side of the sheet of which an image has been formed on a first side (i.e., two-sided image forming is to be performed), the sheet is reversed, and the re-feed conveyance path 98 re-conveys the sheet to the image forming unit G. The re-feed conveyance path 98 is disposed above the sheet cassette 52, which stores the sheet P.

The sheet detection sensor 60 is arranged above the re-feed conveyance path 98, and is arranged to emit light towards a sheet stacking surface of the sheet cassette 52. The hole 76*h* is disposed in the sheet guide of the re-feed conveyance path 98 for allowing the light from the sheet detection sensor 60 to pass through. The reflecting plate 61 for reflecting the light emitted from the sheet detection sensor 60 is disposed on the sheet stacking surface of the sheet cassette 52. As a result, the light emitted from the sheet detection sensor 60 is reflected by the reflecting plate 61 and received by the sheet detection sensor 60.

The re-feed conveyance path 98 may be arranged to be tilted with respect to the sheet stacking surface of the sheet cassette 52. The functions and the effect acquired according to the above-described configuration are similar to those in the first exemplary embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-128130 filed Jun. 5, 2012, which is hereby incorporated by reference herein in its entirety.

What is claimed is:

1. An image forming apparatus that forms an image on a sheet using an image forming unit, the image forming apparatus comprising:

a storage unit configured to store sheets to be fed to the image forming unit;

a feeding unit configured to feed the sheets stored in the storage unit;

a sheet guide disposed above the storage unit and configured to form a sheet conveyance path, on which a sheet is conveyed;

a detection unit disposed above the sheet guide and including a light emitting portion configured to emit light towards the storage unit and a light receiving portion configured to receive light;

a light passage portion disposed in the sheet guide, through which light emitted from the light emitting portion in the detection unit passes;

a reflection portion disposed below the storage unit and configured to reflect, towards the light receiving portion, light emitted from the light emitting portion and having passed through the light passage portion; and a control unit configured to determine, based on an amount of light received by the light receiving portion, whether there is a sheet in the sheet conveyance path and whether there is a sheet stored in the storage unit.

2. The image forming apparatus according to claim 1, wherein the sheet guide is arranged so that the sheet conveyance path is tilted with respect to a bottom surface on which sheets are stacked in the storage unit.

3. The image forming apparatus according to claim 1, wherein the control unit determines, based on an amount of light received by the receiving unit being greater than a first predetermined value when the feeding unit sequentially feeds sheets stored in the storage unit, that there is no sheet stored in the storage unit, and determines, based on an amount of light received by the receiving unit being less than a second predetermined value when a sheet is conveyed by the sheet conveyance path of the sheet guide, that there is a sheet in the sheet conveyance path.

4. The image forming apparatus according to claim 2, wherein the control unit determines, based on an amount of light received by the receiving unit being greater than a first predetermined value when the feeding unit sequentially feeds sheets stored in the storage unit, that there is no sheet stored in the storage unit, and determines, based on an amount of light received by the receiving unit being less than a second predetermined value when a sheet is conveyed by the sheet conveyance path of the sheet guide, that there is a sheet in the sheet conveyance path.

5. The image forming apparatus according to claim 1, wherein a swingable elevating plate configured to support a portion of a leading edge side, in a feeding direction, of a sheet stored in the storage unit is disposed in the storage unit, and wherein the detection unit is arranged so that light emitted from the light emitting portion irradiates, among the sheets stored in the storage unit, a bottom surface of a trailing edge side not supported by the elevating plate.

6. The image forming apparatus according to claim 1, further comprising a pressing unit configured to press a sheet onto the sheet guide near a position where the sheet in the sheet conveyance path is irradiated with the light emitted from the light emitting portion.

7. The image forming apparatus according to claim 1, wherein the sheet guide includes a upper guide and a lower guide, and a gap between the upper guide and the lower guide becomes narrow near a position where a sheet in the sheet conveyance path is irradiated with the light emitted from the light emitting portion.

8. The image forming apparatus according to claim 1, wherein the sheet conveyance path of the sheet guide guides a sheet fed into the image forming apparatus via a feed port disposed on a side of the image forming apparatus.

9. The image forming apparatus according to claim 1, wherein the sheet conveyance path of the sheet guide re-conveys, to the image forming unit, a sheet of which an image has been formed by the image forming unit on a first side, to form an image on a second side of the sheet.

* * * * *